US009295284B2

(12) United States Patent
Prestia et al.

(10) Patent No.: US 9,295,284 B2
(45) Date of Patent: Mar. 29, 2016

(54) APPARATUS FOR INTRODUCING OBJECTS INTO A SMOKING ARTICLE FILTER

(75) Inventors: Ivan Prestia, Bologna (IT); Roberto Libbra, Bologna (IT); Eva Ferrari, Bologna (IT); Fabio Cantieri, Bologna (IT); Diego Ferrazzin, Bologna (IT); Michele Pagnoni, Bologna (IT)

(73) Assignee: PHILIP MORRIS USA INC., Richmond, VA (US)

( * ) Notice: Subject to any disclaimer, the term of this patent is extended or adjusted under 35 U.S.C. 154(b) by 1561 days.

(21) Appl. No.: 12/618,329

(22) Filed: Nov. 13, 2009

(65) Prior Publication Data

US 2010/0184576 A1 Jul. 22, 2010

(30) Foreign Application Priority Data

Nov. 14, 2008 (EP) ..... 08169114

(51) Int. Cl.
*B31C 99/00* (2009.01)
*A24D 3/02* (2006.01)
*A24D 3/06* (2006.01)

(52) U.S. Cl.
CPC ..... *A24D 3/0216* (2013.01); *A24D 3/061* (2013.01)

(58) Field of Classification Search
CPC ..... A24D 3/0216; A24D 3/061
USPC ..... 493/39, 44, 48, 50
See application file for complete search history.

(56) References Cited

U.S. PATENT DOCUMENTS 3,844,200 A * 10/1974 Sexstone ..... 493/45
3,847,064 A * 11/1974 Berger ..... 493/44
4,016,830 A * 4/1977 Sexstone ..... 118/406
4,214,508 A * 7/1980 Washington ..... 493/48
4,425,107 A * 1/1984 Hall ..... 493/48
5,004,579 A * 4/1991 Wislinski et al. ..... 264/517
6,263,882 B1 * 7/2001 Chehab et al. ..... 131/84.1
7,479,098 B2 * 1/2009 Thomas et al. ..... 493/39
7,757,835 B2 * 7/2010 Garthaffner et al. ..... 198/392
2003/0034085 A1 * 2/2003 Spiers et al. ..... 141/125

(Continued)

FOREIGN PATENT DOCUMENTS

CN 1849209 A 8/2004
CN 101164458 A 10/2007

(Continued)

OTHER PUBLICATIONS

European Search Report dated Apr. 22, 2009 for European Patent Application No. 08169114.9-2313.

(Continued)

*Primary Examiner* — Sameh Tawfik
(74) *Attorney, Agent, or Firm* — Buchanan Ingersoll & Rooney PC

(57) ABSTRACT

An apparatus for introducing objects into a smoking article comprises a reservoir for providing a plurality of objects to be introduced into the smoking article, a rotatable wheel for delivering the objects to the location where the objects are to be introduced into the smoking article, a transfer chamber for transferring the objects to the rotatable wheel, the transfer chamber being arranged between the reservoir and the rotatable wheel and being designed such that the objects are aligned into a single vertically arranged layer therein, and means for moving the objects from the single layer in the transfer chamber in a direction towards or along the peripheral surface of the rotatable wheel.

11 Claims, 8 Drawing Sheets

(56) References Cited

U.S. PATENT DOCUMENTS

| | | | | |
|---|---|---|---|---|
| 2004/0020554 | A1* | 2/2004 | Smith et al. | 141/67 |
| 2005/0070409 | A1* | 3/2005 | Deal | 493/44 |
| 2006/0135335 | A1* | 6/2006 | Dawson et al. | 493/39 |
| 2007/0068540 | A1 | 3/2007 | Thomas et al. | |
| 2009/0166376 | A1 | 7/2009 | Garthaffner et al. | |

FOREIGN PATENT DOCUMENTS

| | | | |
|---|---|---|---|
| EP | 1 913 825 | A1 | 4/2008 |
| JP | S63-317072 | A | 12/1988 |
| WO | WO 2005/032286 | | 8/2004 |

OTHER PUBLICATIONS

International Search Report and Written Opinion dated Jan. 19, 2010 for PCT/EP2009/065107.

Notification of the First Office Action, State Intellectual Property Office of the People's Republic of China, dated Mar. 6, 2013.

Office Action issued Nov. 18, 2013 for Japanese Patent Appln. No. 2011-536023.

* cited by examiner

APPARATUS FOR INTRODUCING OBJECTS INTO A SMOKING ARTICLE FILTER

CROSS-REFERENCE TO RELATED APPLICATION

This application claims priority to European Application No. 08169114.9, filed Nov. 14, 2008, the entire content of which is incorporated herein by this reference thereto.

BACKGROUND

The present invention relates to a method and an apparatus for introducing objects into a smoking article. For example, the objects may be beads or capsules which are to be introduced into the filter material during manufacture of the filter component of the smoking article.

Smoking articles, for example cigarettes, typically have a rod-shaped structure and include a charge, roll or column of smokable material such as cut tobacco surrounded by a paper wrapper thereby forming a so-called "smokable rod" or "tobacco rod". A cylindrical filter element is aligned in an end-to-end relationship with the tobacco rod. By way of example, a filter element may include cellulose acetate tow as the filter material (which may have been plasticized), and the tow may be circumscribed by a paper material known as "plug wrap". The filter element is attached to one end of the tobacco rod using a circumscribing wrapping material known as "tipping paper".

The sensory attributes of cigarette smoke can be modified by applying additives to the tobacco and/or by otherwise incorporating flavoring materials into various components of the cigarette. For example, one well-known type of tobacco-flavoring additive is menthol.

Various proposed methods for modifying the sensory attributes of cigarette smoke involve using filter elements as vehicles for adding flavor to the mainstream smoke in the cigarette. For example, it has been suggested to introduce objects such as beads or capsules into the filter material during manufacture of the filter elements.

Various apparatuses have been suggested for the introduction of such objects into the filter material during manufacture of filter elements. Examples of such apparatuses are described in U.S. Pat. No. 4,862,905, in U.S. Pat. No. 7,115,085 and in WO-A-2007/038053.

In the apparatus described in WO-A-2007/038053, the objects to be inserted into the filter material are provided in a reservoir in the form of an upper hopper. A lower hopper is connected to the lower end of the upper hopper. A reciprocating bar having a plurality of vertically extending passageways separates the upper and lower hopper and provides for controlled feed of objects from the upper hopper to the lower hopper through the passageways. The lower hopper is shaped to arrange the objects in multiple rows formed one on top of another. The open bottom of the lower hopper extends over a portion of a rotating wheel comprising individual pockets in which single objects become positioned through gravitational force and can be retained with the aid of vacuum applied to the pocket. The objects retained in the pockets are then transferred through rotation of the rotating wheel to the location where they are to be inserted into a filter material. Release of the objects from the individual pocket and introduction of the objects into the filter material is performed by applying a blast of air to the pocket at a desired time.

There is a particular need in the mass manufacture of cigarette filters that objects be introduced into the filter material at a high speed and in a reliable manner. More generally, there is a need to introduce such objects into a smoking article.

SUMMARY OF SELECTED ASPECTS OF THE INVENTION

A method for introducing objects into a smoking article includes the steps of: providing a reservoir for holding the objects to be introduced into a smoking article; introducing the objects into a transfer chamber arranged such that the objects are aligned into a single vertically arranged layer therein, delivering the objects with a rotatable wheel to a location where the objects are to be introduced into the smoking article, the rotatable wheel arranged adjacent the transfer chamber, and moving the objects from the single vertically arranged layer in the transfer chamber in a direction towards or along a peripheral surface of the rotatable wheel. The step of moving the objects includes moving the objects along a circulating path within the transfer chamber, with the circulating path at the peripheral surface of the rotatable wheel extending in the direction of rotation of the rotatable wheel along the peripheral surface. The step of moving the objects includes moving the objects in a direction towards the peripheral surface of the rotatable wheel within the transfer chamber with the aid of a vacuum.

An apparatus for introducing objects into a smoking article includes a reservoir for providing a plurality of objects to be introduced into a smoking article; a rotatable wheel for delivering the objects to a location where the objects are to be introduced into the smoking article; a transfer chamber for transferring the plurality of objects to the rotatable wheel; and means for moving the objects from the single vertically arranged layer in the transfer chamber in a direction towards or along a peripheral surface of the rotatable wheel. The transfer chamber is arranged between the reservoir and the rotatable wheel and is designed such that the objects are aligned into a single vertically arranged layer therein.

The means for moving the objects includes means for creating a circulating movement of the objects in the transfer chamber such that at the peripheral surface of the rotatable wheel the objects move along a circulating path extending in the direction of rotation of the rotatable wheel. The means for creating the circulating movement of the objects in the transfer chamber includes a plurality of nozzles for blowing air into the interior of the transfer chamber. The nozzles are arranged in a manner such as to generate an air stream causing the movement of the objects along the circulating path. The means for moving the objects includes suction means for generating a vacuum causing the objects in the transfer chamber to move towards the peripheral surface of the rotatable wheel.

The apparatus can also include a rotary brush arranged at the end of the circulating path of the objects along the rotatable wheel. The rotary brush together with a curved side wall of the transfer chamber are arranged to reverse the direction of movement of the objects in the transfer chamber to contribute to the circulating movement therein. The apparatus can also include at least one nozzle for blowing air into the transfer chamber, the at least one nozzle being arranged such that an air stream is generated in the transfer chamber which, together with a curved side wall of the transfer chamber, reverses the direction of movement of the objects in the transfer chamber. The rotatable wheel includes a plurality of individual pockets equidistantly arranged in the peripheral surface of the rotatable wheel. Each individual pocket is adapted to retain a single object during delivery of the objects to the location where the objects are to be introduced into the smoking article. The peripheral surface of the rotatable wheel further includes a groove running about the entire circumference of the rotatable wheel and passing through the individual pockets and a scraper arranged so as to extend into the groove adjacent to the location where the objects are to be introduced into a smoking article. The scraper includes a tip and a sloped surface for releasing the objects from the pockets and guiding the objects to the desired location in a smoking article. Each of the individual pockets of the rotatable wheel is connected at its bottom to a channel extending radially inwardly to a common suction supply channel for applying suction to the individual pockets. Each of the individual pockets of the rotatable wheel is chamfered at a transition to the peripheral surface of the rotatable wheel.

The apparatus can also include a guiding cone for guiding a filter material of the smoking article. The guiding cone has an opening extending in the longitudinal direction of the guiding cone, and the rotatable wheel is adapted and arranged to penetrate through the opening into the interior of the guiding cone for introducing the objects into a filter material. In addition, the apparatus can include a compression tongue arranged downstream of the guiding cone for compressing a filter material with the introduced objects so as to fix the objects in the filter material.

DETAILED DESCRIPTION

Figure 1:
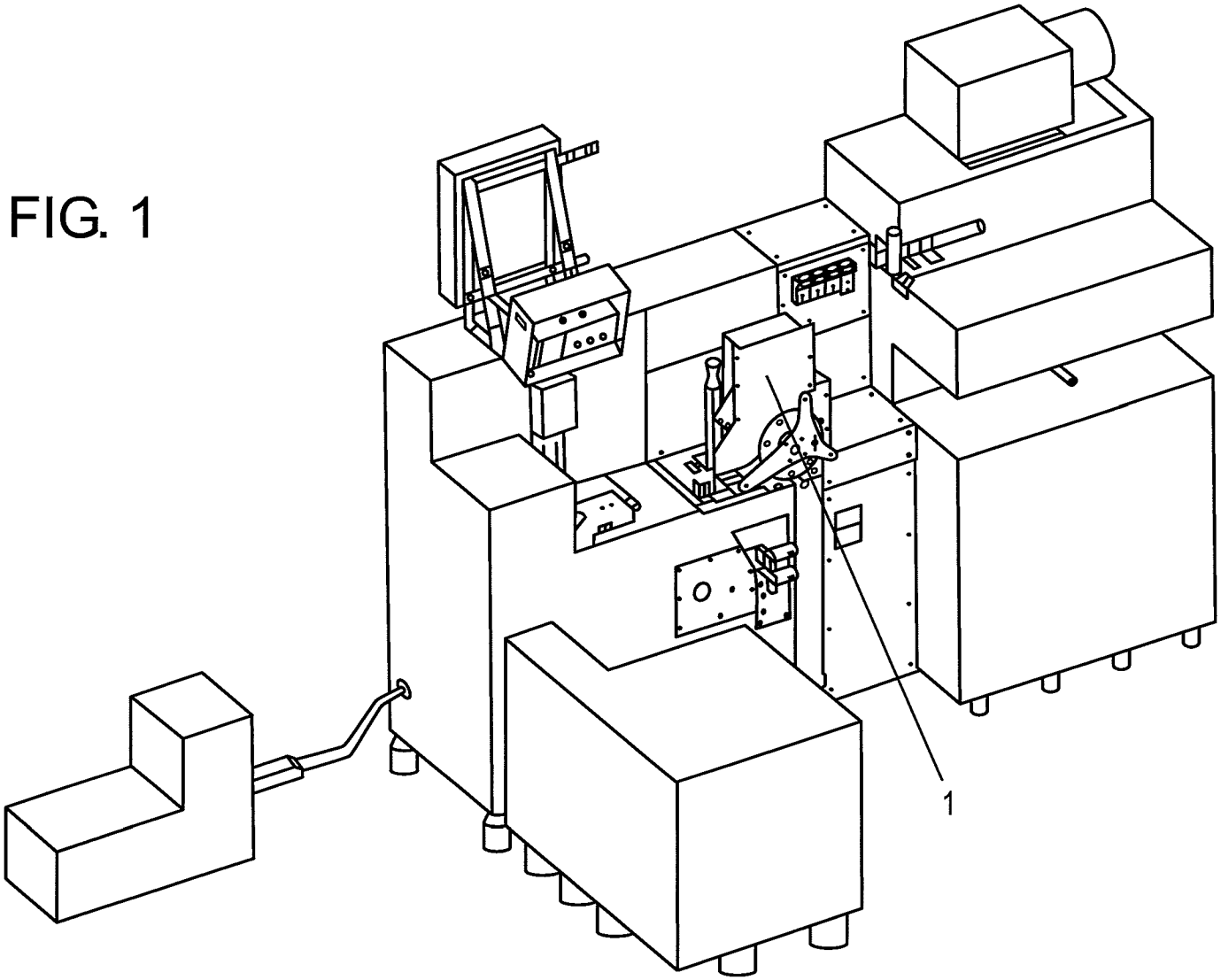
FIG. 1 is an illustration of a machine for forming filter rods including an apparatus according to the invention.

According to the present invention there is provided an apparatus for introducing objects into a smoking articles. While in the following specification only embodiments are discussed in which objects are inserted into the filter material of a smoking article, the invention includes also cases in which the objects are inserted into other parts of the smoking article, e.g. into the tobacco rod or into a cavity in the smoking article. The apparatus includes a reservoir for providing a plurality of objects to be introduced into the smoking article, a rotatable wheel for delivering the objects to a location where the objects are to be introduced into the smoking article, a transfer chamber for transferring the objects to the rotatable wheel, the transfer chamber being arranged between the reservoir and the rotatable wheel and being designed such that the objects are aligned into a single vertically arranged layer therein, and means for moving the objects from the single vertically arranged layer in the transfer chamber in a direction towards or along a peripheral surface of the rotatable wheel. These means for moving the objects from the single layer cause a movement that adds to the movement of the objects due to gravitational forces.

Through the means for moving the objects in a direction towards or along the peripheral surface of the rotatable wheel the apparatus can be operated at high speed, and at the same time the objects can be reliably loaded into the individual pockets of the rotatable wheel where they are retained and delivered to the location where they are introduced into the smoking article in general and into the filter material in particular. By way of example, the objects can be beads, capsules, or pellets however, they can also be of any other suitable type. For instance, the objects can enhance the sensory attributes of cigarette smoke. In particular, they can be used as vehicles for adding flavor to the mainstream smoke.

In one embodiment of the apparatus, the means for moving the objects include means for causing a circulating movement of the objects in the transfer chamber such that at the peripheral surface of the rotatable wheel the objects move along a circulating path extending in the direction of rotation of the rotatable wheel. In one particular embodiment of the apparatus, these means for causing the circulating movement of the objects in the transfer chamber include a plurality of nozzles for blowing air into the interior of the transfer chamber. The nozzles are arranged to generate an air stream causing the movement of the objects along the circulating path.

The objects are accelerated by the air blown into the transfer chamber by the nozzles so that they are moving along the circulating path. This allows the speed of the rotatable wheel and the filter material to be increased and reliably transfers the objects from the transfer chamber into the individual pockets of the rotatable wheel, thus increasing the overall production rate of the filter elements.

A further embodiment of an apparatus also includes a rotary brush arranged at the end of the circulating path of the objects along the rotatable wheel. The rotary brush together with a curved side wall of the transfer chamber are arranged to reverse the direction of movement of the objects in the transfer chamber, which contributes to the circulating movement therein. While the rotary brush is generally optional, it supports reversing the direction of movement of the objects and may further enhance the movement of the objects along the circulating path.

In an alternative embodiment of the apparatus the means for moving the objects include suction means for generating a vacuum causing the objects in the transfer chamber to move towards the peripheral surface of the rotatable wheel. This embodiment also allows the speed of the rotatable wheel and the speed of the filter material to be increased while at the same time reliably loading the objects from the transfer chamber into the individual pockets of the rotatable wheel since the forces pulling the objects into the pockets of the rotatable wheel are increased through the application of the suction. Thus, this measure also may increase the overall production rate of the filter elements. Also, the application of vacuum according to this alternative embodiment to make the objects move towards the rotatable wheel can be combined with the above-discussed embodiment causing the circulating movement of the objects within the transfer chamber.

One variant of the alternative embodiment of the apparatus further includes at least one nozzle for blowing air into the transfer chamber, the nozzle being arranged such that an air stream is generated in the transfer chamber which, together with a curved side wall of the transfer chamber, reverses the direction of movement of the objects in the transfer chamber. The nozzle supports the reversal in direction of movement of the objects that have passed through the transfer chamber along the peripheral surface of the rotatable wheel but have not entered a pocket of the rotatable wheel.

According to a further embodiment of the apparatus, regardless of whether air is blown in the transfer chamber to make the objects circulate or suction is applied to increase the forces pulling the objects into the pockets of the rotatable wheel or both, the rotatable wheel includes a plurality of individual pockets equidistantly arranged in the peripheral surface of the rotatable wheel, with each individual pocket being adapted to retain a single object during delivery of the objects to the location where the objects are introduced into the smoking article in general and into the filter material in particular. The peripheral surface of the rotatable wheel further includes a groove that runs about the entire circumference of the rotatable wheel and passes through the individual pockets. Suction, for example in the form of a vacuum, is applied to each individual pocket in order to retain the object in the pocket during delivery from the transfer chamber to the location where the object is to be introduced into the smoking article in general and into the filter material in particular.

A scraper is arranged in a manner so as to extend into the groove adjacent to the location where the objects are to be introduced into the smoking article or the filter material, respectively. The scraper has a tip and a sloped surface for releasing the objects from the pockets and guiding them to the desired location in the smoking article or the filter material. The tip of the scraper functions to break the vacuum applied to the individual pockets of the rotatable wheel, so that upon further rotation of the rotatable wheel the object is guided along the sloped surface of the scraper until it reaches the desired position in the smoking article or filter material. This solution allows for a reliable release of the object from the respective pocket, and further allows the object to be precisely guided to the desired location in the smoking article in general and in the filter material in particular.

In an additional embodiment of the apparatus, each of the individual pockets of the rotatable wheel is connected at its bottom to a channel extending radially inwardly to a common suction supply channel for applying the suction to the individual pockets. The common suction supply channel distributes the vacuum from one vacuum source to the individual pockets of the rotatable wheel.

In a further embodiment of the apparatus, the individual pockets of the rotatable wheel are chamfered at a transition to the peripheral surface of the rotatable wheel. The chamfered transition further provides for the objects to reliably enter into the pockets of the rotatable wheel from the transfer chamber.

Another embodiment of the apparatus according to the invention further includes a guiding cone for guiding the filter material. The guiding cone has an opening extending in the longitudinal direction of the guiding cone, and the rotatable wheel is adapted and arranged to penetrate through the opening into the interior of the guiding cone for introducing the objects into the filter material. Additionally, a compression tongue may be provided which is arranged downstream of the guiding cone for compressing the filter material with the introduced objects so as to fix the objects in the filter material after they have been introduced into the filter material.

The production of filter rods is well-known in the art and can be performed with commercially available filter making machinery such as, for example, the KDF2-AF2 unit of Hauni-Werke Kober & Co. KG, Hamburg, Germany. With such machinery, filter rods which are later cut into single filter elements can be manufactured. It is also known, that such apparatus can be modified to allow the introduction of objects into the filter material at predetermined intervals within a continuous length of filter material.

FIG. 1 shows a machine for forming filter rods including an apparatus 1 for introducing objects into the filter material according to the invention. The filter material can be supplied from a source (not shown) such as a storage bale, bobbin, or the like in form of a continuous strand of filter material. The continuous filter material is drawn through the apparatus 1 for introducing objects into the filter material, and the individual objects are introduced at predetermined intervals into the filter material.

Figure 2:
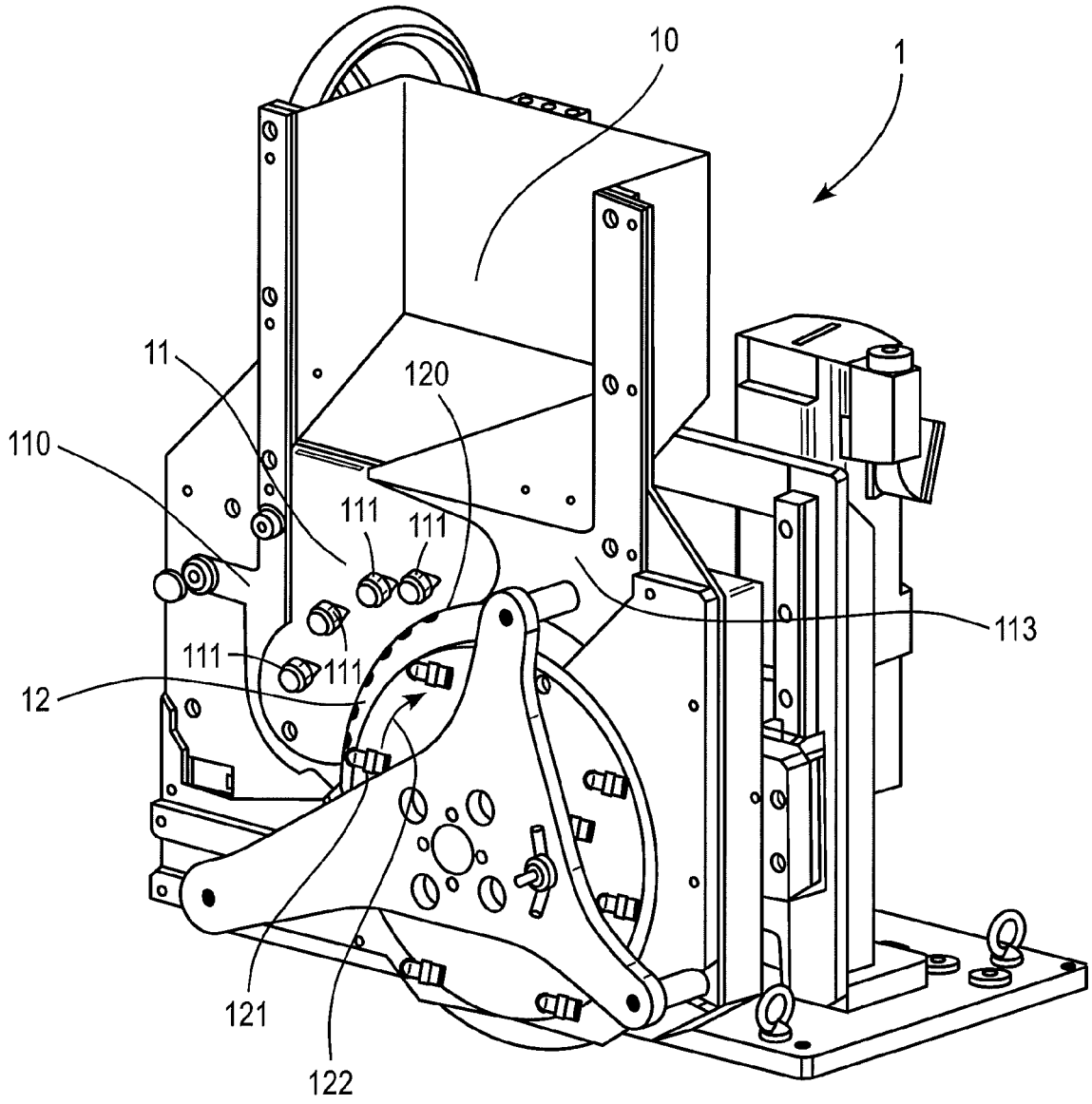
FIG. 2 is a perspective view of essential components of an apparatus for introducing objects into the filter material according to a first embodiment of the invention.

A first embodiment of the apparatus 1 for introducing objects into the filter material shown in FIG. 1 is shown in a perspective view in FIG. 2. It includes a reservoir 10 for the objects to be introduced into the filter material, and a transfer chamber 11 for feeding the objects to a rotatable wheel 12. Suitable objects are, by way of example, beads, capsules or pellets, or any other suitable objects depending on the respective purpose they serve. Within the transfer chamber 11 the objects form a single vertically arranged layer. The transfer chamber 11 is formed by the side walls of two guides, a left guide 110 and a right guide 113. The left guide 110 has a shape so as to ease and maximize the turning motion of the beads. It is preferably adjustable so as to be placed in the optimal position for the beads motion. The right guide 113 limits the weight of the beads stored in the reservoir 10 acting on the beads in the transfer chamber 11 (by determining the size of the opening between the reservoir 10 and the transfer chamber 11). Also, as already mentioned it is shaped to ease and maximize the turning motion of the beads within the transfer chamber 11. Nozzles 111 are provided for causing a circulating movement of the objects within the transfer chamber 11 to improve insertion into the pockets 120 of the rotatable wheel 12. The rotatable wheel 12 serves to deliver the objects to the location where they are to be introduced into the filter material. During its operation it rotates in the direction of arrow 122. The rotatable wheel 12 includes a plurality of individual pockets 120 which are adapted to securely retain the respective objects within the individual pockets 120 during delivery of the objects to the location where they are to be introduced into the filter material. As will be explained in more detail below, each object remains well positioned in the respective pocket 120 of the transfer wheel 12 with the aid of suction 121 applied until the insertion of the object into the filter material is desired. The objects are then ejected from the pockets 120 of the transfer wheel 12 with the aid of a pressurized air blast or any other suitable means.

Figure 3:
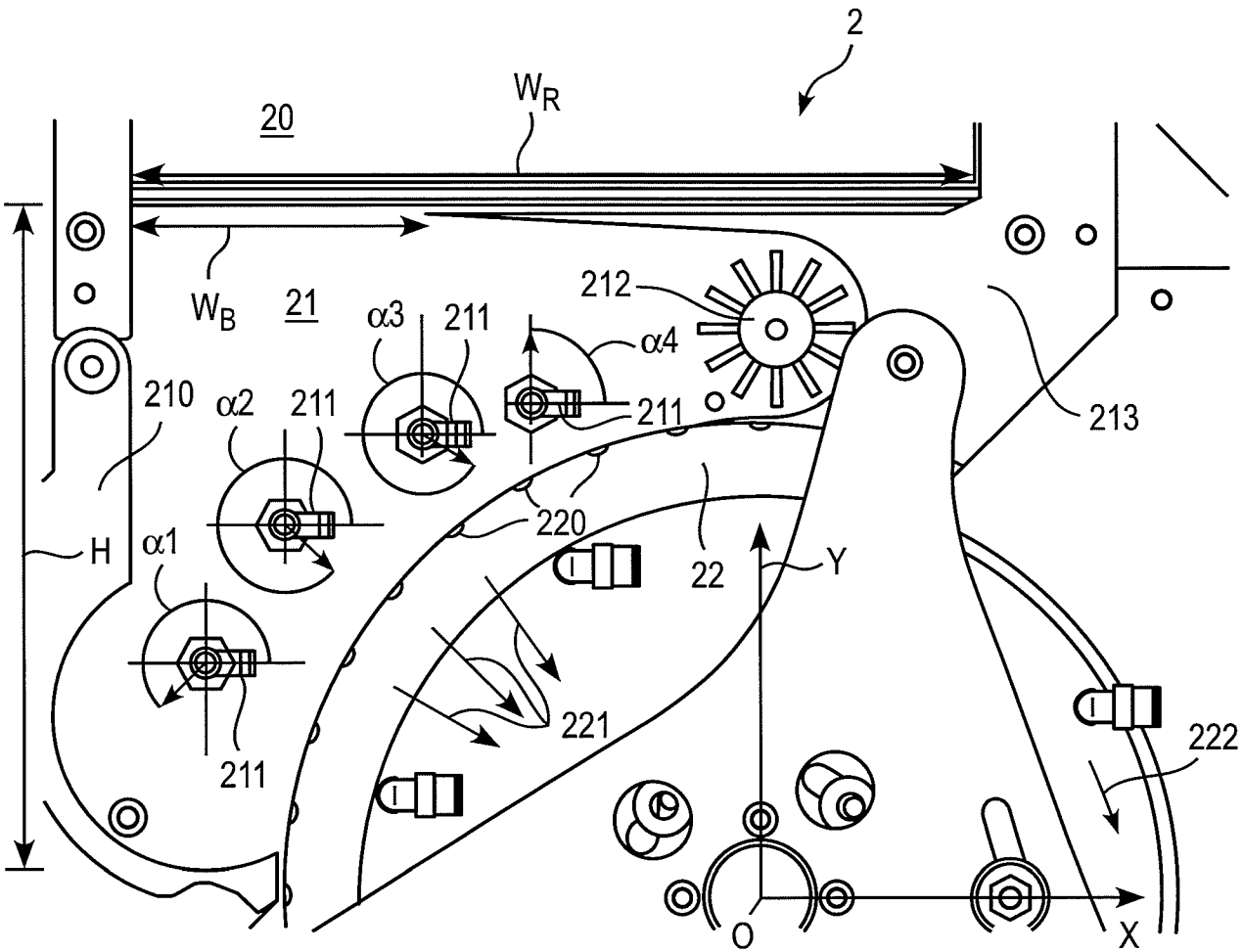
FIG. 3 shows a second embodiment of the apparatus for introducing objects into filter material according to the invention.

In FIG. 3 there is shown a second embodiment of essential parts of an apparatus 2 for introducing objects into a filter material. Suitable objects are, by way of example, beads, capsules or pellets, or any other suitable objects depending on the respective purpose they serve. The apparatus includes a reservoir 20 for the objects to be inserted, and a transfer chamber 21 formed by the side walls of two guides, a left guide 210 and a right guide 213. The left guide 210 has a shape so as to ease and maximize the turning motion of the beads. It is preferably adjustable so as to be placed in the optimal position for the beads motion. The right guide 213 limits the weight of the beads stored in the reservoir 20 acting on the beads in the transfer chamber 21. Also, as already mentioned it is shaped to ease and maximize the turning motion of the beads within the transfer chamber 21. The transfer chamber 21 is arranged between the reservoir 20 and a rotatable wheel 22, which serves to deliver the objects to the location where they are to be introduced into the filter material. The rotatable wheel 22, which during operation rotates in the direction of arrow 222, includes a plurality of individual pockets 220 which are adapted to securely retain the respective object within the individual pockets 220 during delivery of the objects to the location where they are to be introduced into the filter material. Introducing and retaining of the objects in the individual pockets 220 of the rotatable wheel 22 is achieved with the aid of suction applied to the pockets, as indicated by the arrows 221. The suction zone extends about roughly three quarters of the rotatable wheel 22 down to the location where a scraper 23 is arranged (see FIG. 12). The scraper 23 serves to release the objects from the pockets 220 of the rotatable wheel 22 as will be described in more detail below. Also, a plurality of nozzles 211 for blowing air into the transfer chamber 21 are arranged within transfer chamber 21 for causing a circulating movement of the objects within the transfer chamber 21. In addition, a rotary brush 212 may be arranged within the transfer chamber 21. The brush 212 may contribute to the circulating movement of the objects within the transfer chamber 21, because together with a curved sidewall of the right guide 213 defining the transfer chamber 21 it causes the direction of movement of those objects not having been transferred to the rotating wheel 22 to be reversed within the transfer chamber 21 so as to move back and later on to enter into the forward flow of the beads along the peripheral surface of the rotating wheel 22. The faster the motion of the beads along the peripheral surface of the transfer wheel 22 the better the beads transfer rate onto the transfer wheel 22 (and the more the overall operational speed can be increased).

By way of example only, the rotatable wheel may have a diameter of about 309.2 mm (corresponding to a radius of about 154.6 mm) and the center of the rotatable wheel 22 may form the origin O of a Cartesian coordinate system with the x- and y-axes shown in FIG. 3 and the units on the x- and y-axes being measured in millimeters (mm). The lowermost nozzle 211 may then be arranged at the coordinates x1 and y1, the second lowermost nozzle 211 may be arranged at the coordinates x2 and y2. The second uppermost nozzle 211 may be arranged at the coordinates x3 and y3, and the uppermost nozzle 211 may be arranged at coordinates x4 and y4. The respective angles under which the nozzles 211 blow air into transfer chamber 21 may be α1 for the lowermost nozzle 211, α2 for the second lowermost nozzle 211, α3 for the second uppermost nozzle 211 and α4 for the uppermost nozzle 211 (all angles measured anticlockwise, as can be seen in FIG. 3). Examples for set values and the possible ranges of the various coordinates, angles and of the air pressure supplied to the nozzles 211 are included in the following table.

| Description | Unit | Minimum Value | Maximum Value | Set value |
|---|---|---|---|---|
| angle α1 | deg | 200 | 250 | 225 |
| pressure lowermost nozzle 211 | MPa | 1 | 5 | 3 |

-continued

| Description | Unit | Minimum Value | Maximum Value | Set value |
|---|---|---|---|---|
| x1-coordinate lower-most nozzle 211 | mm | −190 | −170 | −180.5 |
| y1-coordinate lowermost nozzle 211 | mm | 65 | 85 | 75 |
| angle α2 | deg | 290 | 340 | 315 |
| pressure second lowermost nozzle 211 | MPa | 1 | 5 | 3 |
| x2-coordinate second lowermost nozzle 211 | mm | −145 | −165 | −155.5 |
| y2-coordinate second lowermost nozzle 211 | mm | 110 | 130 | 120 |
| angle α3 | deg | 305 | 355 | 330 |
| pressure second uppermost nozzle 211 | MPa | 1 | 5 | 3 |
| x3-coordinate second uppermost nozzle 211 | mm | −120 | −100 | −110.5 |
| y3-coordinate second uppermost nozzle 211 | mm | 140 | 160 | 150 |
| angle α4 | deg | 65 | 115 | 90 |
| pressure uppermost nozzle 211 | MPa | 1 | 5 | 3 |
| x4-coordinate upper-most nozzle 211 | mm | −65 | −45 | −55.5 |
| y4-coordinate upper-most nozzle 211 | mm | 165 | 185 | 175 |

The reservoir 20 may have a width $w_R$ of about 275 mm, and the width $w_B$ of the opening connecting reservoir 20 with transfer chamber 21 has a width of at least the diameter of one single bead plus 0.2 to 0.5 mm, so that at least one column of beads may enter into transfer chamber 21 through the said opening. The height H of the transfer chamber 21 may be H=230 mm. It goes without saying that the above-listed values represent only one specific embodiment, and that variations of these values are very well possible without departing from the spirit of the invention.

Figure 4:
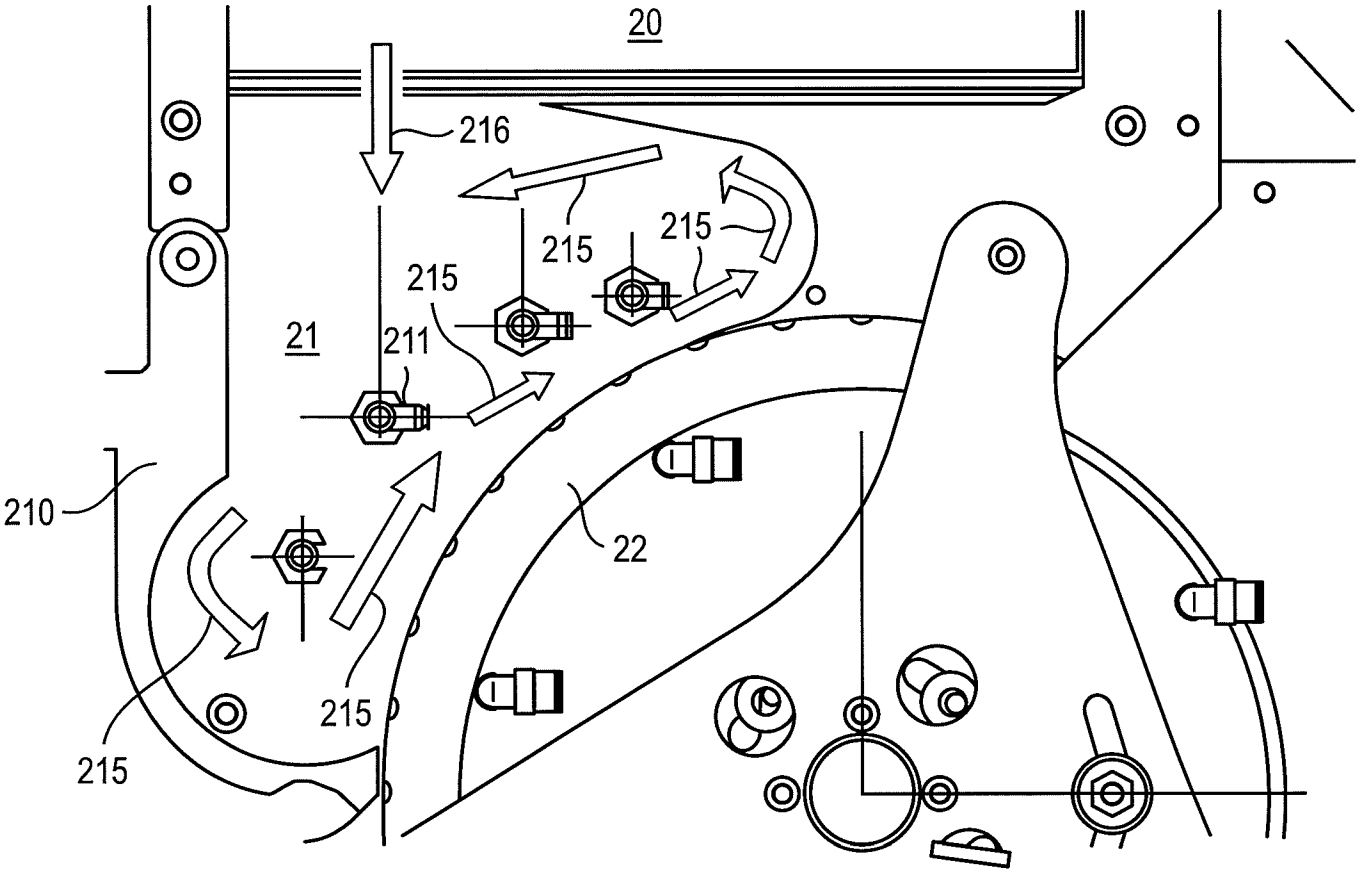
FIG. 4 is a schematic drawing showing the circulating movement of the objects (not shown) in the transfer chamber of a third embodiment of the apparatus according to the invention.

The circulating movement of the objects within the transfer chamber 21 is illustrated in FIG. 4 showing a third embodiment of an apparatus according to the invention (without a rotary brush). The air is blown into the transfer chamber 21 with the aid of the nozzles 211, and the resulting circulating movement of the objects is indicated by the arrows 215. Finally, arrow 216 indicates the movement of the objects which is caused by the gravitational force acting upon the objects which are moving downwards from the reservoir 20 into the transfer chamber 21. The dimensions of the transfer chamber, the arrangement of the nozzles, etc. of this embodiment may be different from those of the embodiment shown in FIG. 3 due to the fact that the embodiment shown in FIG. 4 does not include a rotary brush.

Figure 5:
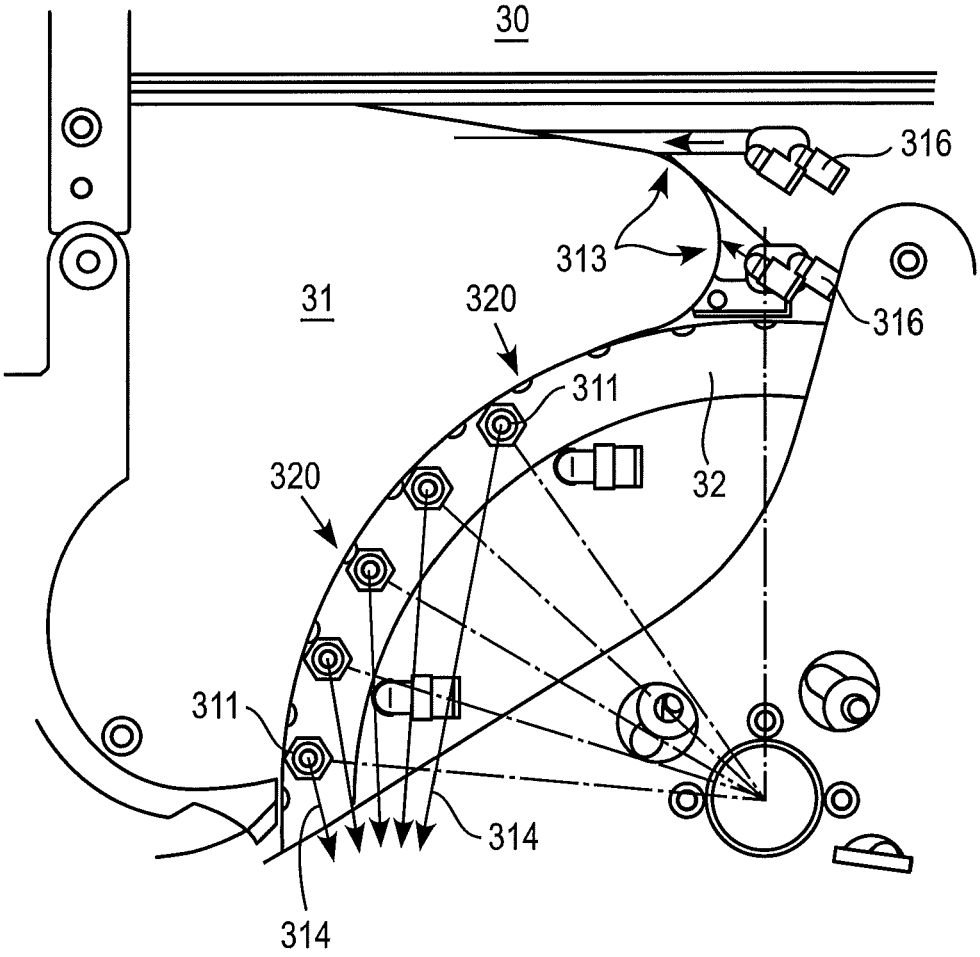
FIG. 5 is an illustration of a fourth embodiment of the apparatus for introducing objects into filter material according to the invention.

In FIG. 5 a fourth embodiment of the apparatus for introducing objects into a filter material is shown. In this embodiment of the apparatus 3, which also has a reservoir 30 for the objects to be inserted, the additional movement of the objects is generated by applying additional suction, for example a vacuum, through front plate suction channels 311 the openings of which are shown in FIG. 5. Thus, additional suction air streams are generated as indicated by the respective arrows 314. In addition, in that portion of the transfer chamber 31 close to the curved wall portion 313, nozzles 316 are arranged to cause the direction of movement of the objects to be reversed in the transfer chamber 31 so as to move them into the flow of objects coming from the reservoir 30. The additional suction improves the transfer of the objects into the pockets 320 of the rotatable wheel 32 and, accordingly, the overall speed of the process of introducing objects into the filter material can be increased.

Figure 6:
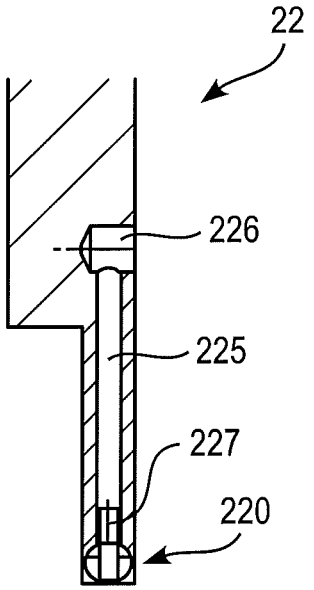
FIG. 6 is an illustration showing a portion of the rotatable wheel of the apparatus according to the invention.
Figure 7:
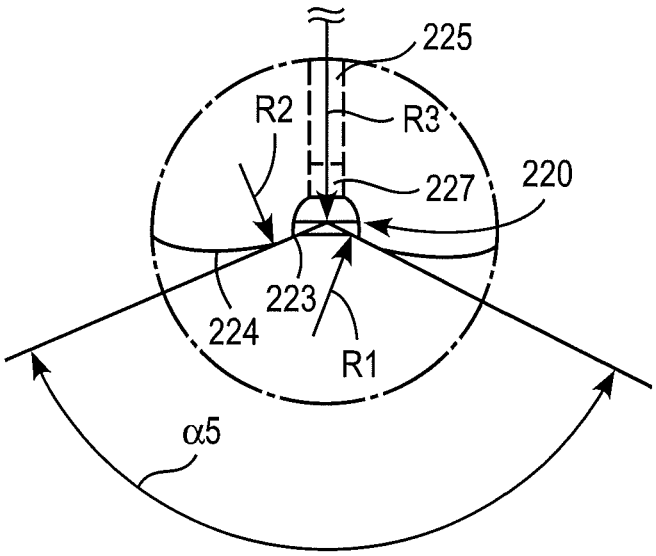
FIG. 7 is a detailed illustration of the chamfered portion of a pocket of the rotatable wheel.

FIG. 6 and FIG. 7 show details of an embodiment of a rotatable wheel 22 or 32, respectively. In the following, it will only be referred to the embodiment of rotatable wheel 22, however, the description similarly applies for the embodiment of rotatable wheel 32. Accordingly, from FIG. 7 it can be seen that the respective pocket 220 has chamfered portions 223 each including two curved portions having a radii R1 and R2, respectively, so that a smooth transition from the pocket 220 to the peripheral surface 224 of the transfer wheel 22 is formed. The chamfered portions 223 include an angle $\alpha$5 between them. The smooth transition from the pocket 220 to the peripheral surface 224 of the transfer wheel 22 makes it easier for the object (e.g. a bead, capsule or pellet) to enter into the pocket 220. The center of the pocket 220 is located at a radius R3 measured from the center of the transfer wheel 22. By way of example, for beads having a diameter of 3.5 mm, the radii R1 and R2 may each be 5 mm (or in a range of 2 mm to 8 mm), and the angle $\alpha$5 may be 130° (or in a range of 20° to 160°). The radius R3 may be 152.7 mm (or in a range of 20 mm to 240 mm) for a transfer wheel having an outer diameter of 302.9 mm. As a consequence, when the beads are placed in the pockets 220 the outer diameter counted from the center of the transfer wheel 22 is 308.9 mm (2×152.7 mm+3.5 mm) so that the beads are always completely arranged in the pockets 220 (with the aid of the vacuum sucking them into pockets 220) and do not project outwardly beyond the outer diameter of the transfer wheel (this outer diameter being 309.2 mm, see FIG. 3). Accordingly, the beads are always retained in the pocket until they are mechanically forced out of the respective pocket with the aid of the scraper, as is described further below.

Each pocket 220 is connected at its bottom to a channel 225 extending radially inwardly to a common suction supply channel 226 (see FIG. 6). Also, from FIG. 6 and FIG. 7 it can be seen that the peripheral surface 224 of the rotatable wheel 22 includes a groove 227 running about the entire circumference of the rotatable wheel and passes through the individual pockets 220. The groove 227 connects the pockets 220 so that the suction applied to the pocket is partly distributed along the groove 227. Thus, the suction applied to the pockets serves two purposes: firstly, it makes the beads in the transfer chamber move towards the respective individual pockets 220 so as to allow the beads to be moved into the pockets 220, and secondly it serves to retain the beads in the pockets 220 once they are in the pockets 220. FIG. 9 shows a greatly enlarged view of the pocket 220 of the rotatable wheel 22 with an object in form of a bead 4 being retained in the pocket 220. It can be seen, that the groove 227 is sufficiently deep so as to allow the tip 230 of the scraper 23 (shown in FIGS. 8 and 12) to enter the groove just prior to the location where the bead 4 is to be introduced into the filter material.

Figure 8:
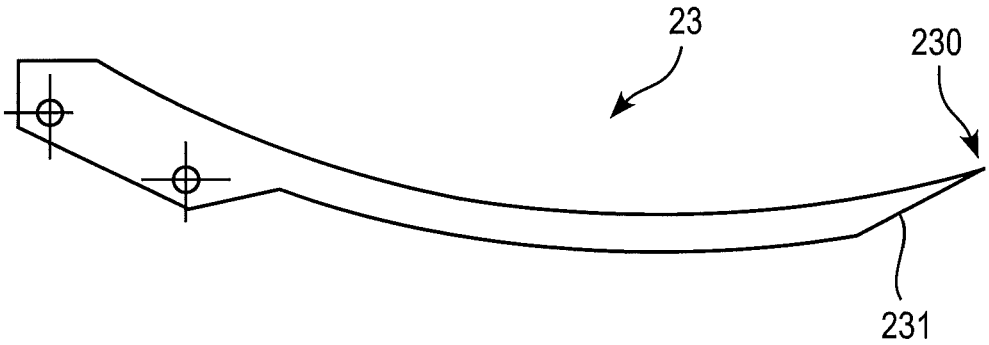
FIG. 8 is an illustration of an embodiment of a scraper for releasing an object from the pocket of the rotatable wheel.
Figure 9:
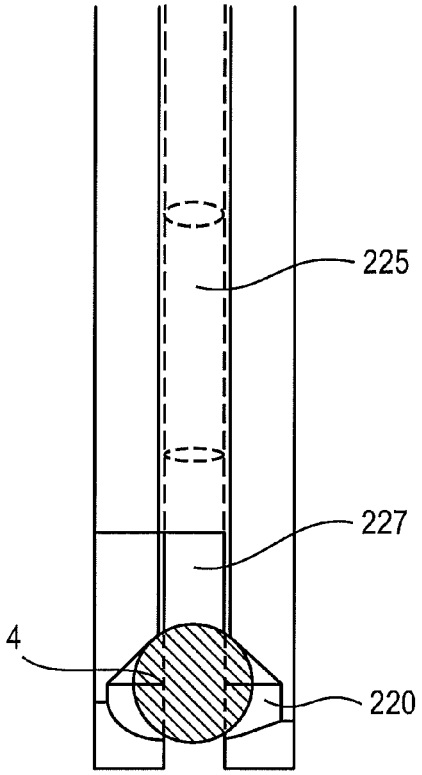
FIG. 9 is an enlarged view of an individual pocket of the rotatable wheel.

One embodiment for such scraper 23 is shown in FIG. 8 to have a tip 230 and a sloped surface 231 for releasing the objects from the pockets 220 and for guiding the objects to the desired location in the filter material. This will be explained in more detail below.

Figure 10:
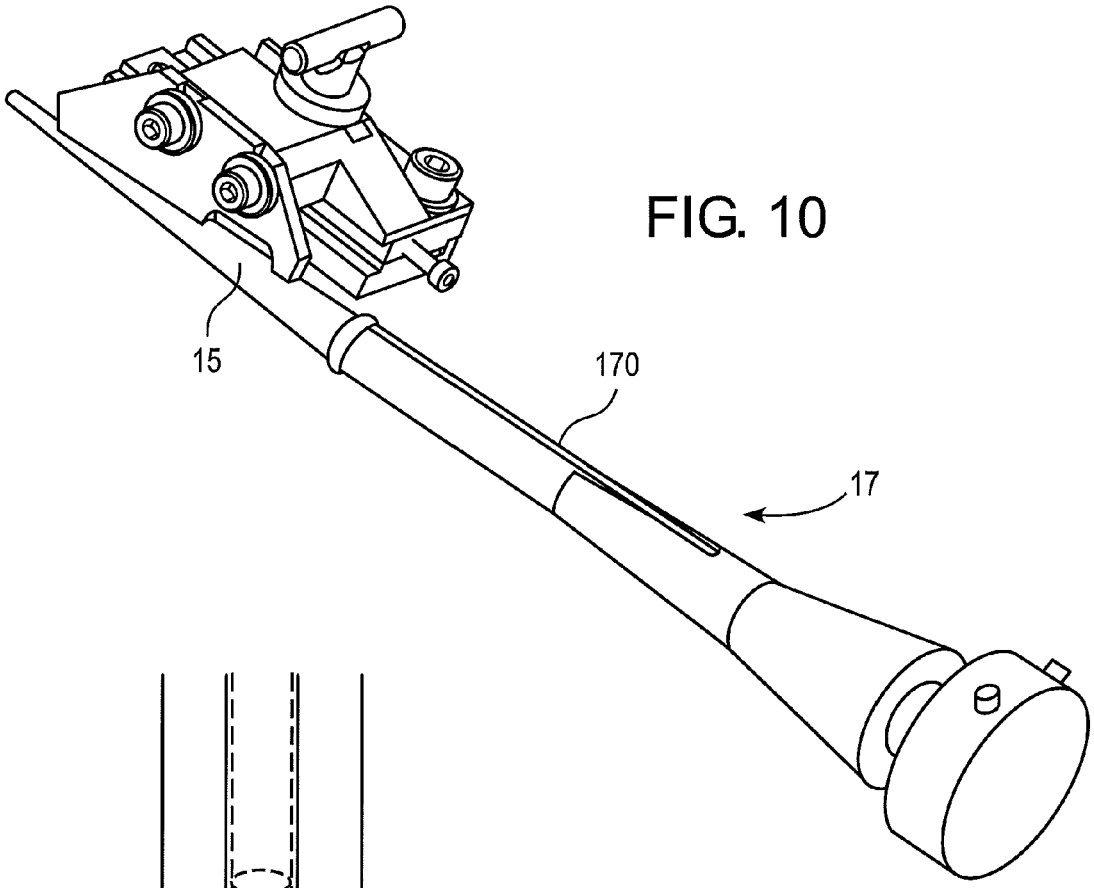
FIG. 10 is an illustration of a guiding cone for guiding the filter material having a longitudinally extending opening, and a compression tongue arranged downstream of the guiding cone.

FIG. 10 shows a guiding cone 17 through which the filter material into which the objects are to be inserted is guided. By way of example, for a bead having a diameter of 3.5 mm, the inner diameter of guiding cone 17 may be in the range of 7 mm to 21 mm and may in particular be 13 mm at the location where the bead is inserted into the filter material. The guiding cone 17 has an opening 170 extending in the longitudinal direction of the guiding cone 17. Downstream of the guiding cone 17 a tongue 15 may be arranged which serves for further compaction of the filter material after having passed through the guiding cone 17. With the exception of the longitudinally extending slit 170 the guiding cone 17 is more or less conventional.

Figure 11:
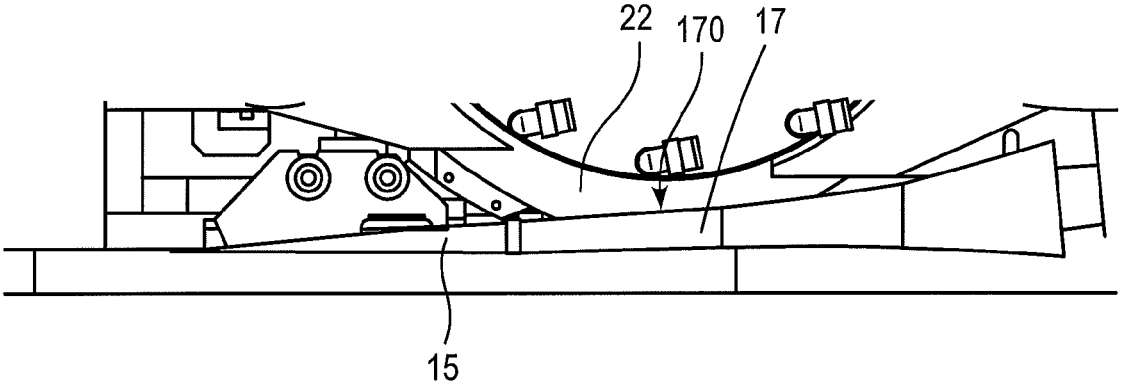
FIG. 11 is a side view showing the penetration of the rotatable wheel into the opening of the guiding cone.
Figure 12:
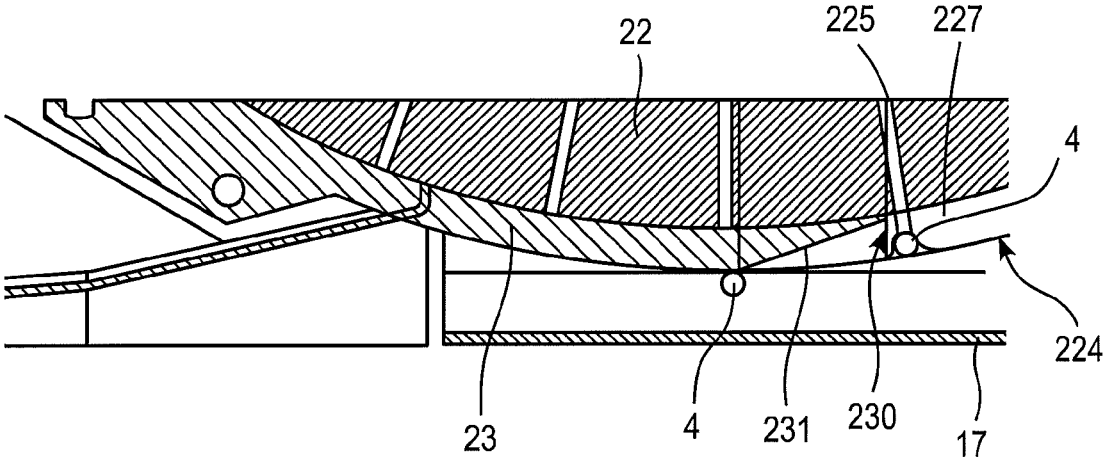
FIG. 12 is a sectional view illustrating the arrangement of the rotatable wheel in the opening of the guiding cone, and of the scraper for releasing and positioning the object in the filter material.

FIG. 11 and FIG. 12 show a side and a sectional view illustrating the penetration of the rotatable wheel into the opening of the guiding cone. From FIG. 11 it can be seen that the rotatable wheel 22 penetrates through the opening 170 into the cone 17 so that the object can be introduced into the filter material guided through the guiding cone 17. As already mentioned, by way of example, for a bead having a diameter of 3.5 mm, the inner diameter of guiding cone 17 may be in the range of 7 mm to 21 mm and may in particular be 13 mm at the location where the bead is inserted into the filter material. The bead may be inserted at a height of about 5.5 mm measured from the bottom of the guiding cone. However, it is clear that these values may vary within suitable ranges. Therefore, the height of the center of the wheel can be adjusted so as to precisely arrange the transfer wheel such that the bead is inserted into the filter material at the optimal position. From FIG. 12 it can be seen, that the scraper 23 is arranged within the groove 227 running along the entire circumference of the peripheral surface 224 of the rotatable wheel 22. Once the pocket in which the bead 4 is retained by means of the suction applied through channel 225 reaches the tip 230 of the scraper 23, the application of suction through the channel 225 is interrupted or at least greatly reduced by the presence of the scraper. Further rotation of the rotatable wheel 22 causes the bead 4 to be guided along the sloped surface 231 of the scraper until the bead 4 reaches its destination position within the filter material, this position being shown in FIG. 12 as the lowermost position of the bead 4. The filter material flowing through guiding cone 17 then carries the bead 4 along with it, and immediately downstream cone 17 the filter material with the introduced bead 4 is further compressed within the tongue 15, whereby the bead 4 is definitively fixed in the desired position within the filter material. The so formed rod of filter material containing beads in predetermined spaced relationship can then be further processed as this has been described further above.

In this specification, the word "about" is often used in connection with numerical values to indicate that mathematical precision of such values is not intended. Accordingly, it is intended that where "about" is used with a numerical value, a tolerance of ±10% is contemplated for that numerical value.

In this specification the words "generally" and "substantially" are sometimes used with respect to terms. When used with geometric terms, the words "generally" and "substantially" are intended to encompass not only features which meet the strict definitions but also features which fairly approximate the strict definitions. In this connection, the term "curved" is intended to also include configurations comprising two or more substantially straight line segments describing the "curved" feature.

While the foregoing describes in detail a preferred a method and an apparatus for introducing objects into a smoking article with reference to a specific embodiment thereof, it will be apparent to one skilled in the art that various changes and modifications may be made to the apparatus and equivalent methods may be employed, which do not materially depart from the spirit and scope of the foregoing description. Accordingly, all such changes, modifications, and equivalents that fall within the spirit and scope of the appended claims are intended to be encompassed thereby.

We claim:

1. An apparatus for introducing objects into a smoking article filter, comprising:

a reservoir for providing a plurality of objects to be introduced into a smoking article filter;

a rotatable wheel for delivering the objects to a location where the objects are to be introduced into a smoking article filter;

a transfer chamber for transferring the plurality of objects to the rotatable wheel, the transfer chamber being arranged between the reservoir and the rotatable wheel and being designed such that the objects are aligned into a single vertically arranged layer therein; and means for moving the objects from the single vertically arranged layer in the transfer chamber in a direction towards or along a peripheral surface of the rotatable wheel, wherein the means for moving the objects comprises means for creating a circulating movement of the objects in the transfer chamber such that at the peripheral surface of the rotatable wheel the objects move along a circulating path extending in the direction of rotation of the rotatable wheel.

2. The apparatus of claim 1, wherein the means for creating the circulating movement of the objects in the transfer chamber comprises a plurality of nozzles for blowing air into the interior of the transfer chamber, the nozzles being arranged in a manner such as to generate an air stream causing the movement of the objects along the circulating path.

3. The apparatus of claim 1, further comprising a rotary brush arranged at the end of the circulating path of the objects along the rotatable wheel, the rotary brush together with a curved side wall of the transfer chamber arranged to reverse the direction of movement of the objects in the transfer chamber to contribute to the circulating movement therein.

4. The apparatus of claim 1, wherein the means for moving the objects comprises suction means for generating a vacuum causing the objects in the transfer chamber to move towards the peripheral surface of the rotatable wheel.

5. The apparatus of claim 4, further comprising at least one nozzle for blowing air into the transfer chamber, the at least one nozzle being arranged such that an air stream is generated in the transfer chamber which, together with a curved side wall of the transfer chamber, reverses the direction of movement of the objects in the transfer chamber.

6. The apparatus of claim 1, wherein:

the rotatable wheel comprises a plurality of individual pockets equidistantly arranged in the peripheral surface of the rotatable wheel, each individual pocket being adapted to retain a single object during delivery of the objects to the location where the objects are to be introduced into the smoking article filter, the peripheral surface of the rotatable wheel further comprises a groove running about the entire circumference of the rotatable wheel and passing through the individual pockets; and a scraper arranged so as to extend into the groove adjacent to the location where the objects are to be introduced into a smoking article filter, the scraper having a tip and a sloped surface for releasing the objects from the pockets and guiding the objects to the desired location in a smoking article filter.

7. The apparatus of claim 6, wherein each of the individual pockets of the rotatable wheel is connected at its bottom to a channel extending radially inwardly to a common suction supply channel for applying suction to the individual pockets.

8. The apparatus of claim 6, wherein each of the individual pockets of the rotatable wheel is chamfered at a transition to the peripheral surface of the rotatable wheel.

9. The apparatus of claim 1, further comprising a guiding cone for guiding a filter material of the smoking article filter, the guiding cone having an opening extending in the longitudinal direction of the guiding cone, and the rotatable wheel being adapted and arranged to penetrate through the opening into the interior of the guiding cone for introducing the objects into a filter material.

10. The apparatus of claim 9, further comprising a compression tongue arranged downstream of the guiding cone for compressing a filter material with the introduced objects so as to fix the objects in the filter material.

11. An apparatus for introducing objects into a smoking article filter, comprising:

a reservoir for providing a plurality of objects to be introduced into a smoking article filter;

a rotatable wheel for delivering the objects to a location where the objects are to be introduced into a smoking article filter;

a transfer chamber for transferring the plurality of objects to the rotatable wheel, the transfer chamber being arranged between the reservoir and the rotatable wheel and being designed such that the objects are aligned into a single vertically arranged layer therein; and means for moving the objects from the single vertically arranged layer in the transfer chamber in a direction towards or along a peripheral surface of the rotatable wheel, wherein the means for moving the objects comprises means for creating a circulating movement of the objects in the transfer chamber such that at the peripheral surface of the rotatable wheel the objects move along a circulating path extending in the direction of rotation of the rotatable wheel, wherein the means for creating the circulating movement of the objects in the transfer chamber comprises a plurality of nozzles for blowing air into the interior of the transfer chamber, the nozzles being arranged in a manner such as to generate an air stream causing the movement of the objects along the circulating path and the means for moving the objects comprises suction means for generating a vacuum causing the objects in the transfer chamber to move towards the peripheral surface of the rotatable wheel, wherein the rotatable wheel comprises a plurality of individual pockets equidistantly arranged in the peripheral surface of the rotatable wheel, each individual pocket being adapted to retain a single object during delivery of the objects to the location where the objects are to be introduced into the smoking article filter, the peripheral surface of the rotatable wheel further comprises a groove running about the entire circumference of the rotatable wheel and passing through the individual pockets; and a scraper arranged so as to extend into the groove adjacent to the location where the objects are to be introduced into a smoking article filter, the scraper having a tip and a sloped surface for releasing the objects from the pockets and guiding the objects to the desired location in a smoking article filter, and wherein each of the individual pockets of the rotatable wheel is connected at its bottom to a channel extending radially inwardly to a common suction supply channel for applying suction to the individual pockets and each of the individual pockets of the rotatable wheel is chamfered at a transition to the peripheral surface of the rotatable wheel.

* * * * *